US011085095B2

(12) United States Patent
Eguchi et al.

(10) Patent No.: US 11,085,095 B2
(45) **Date of Patent: *Aug. 10, 2021**

(54) HIGH-STRENGTH SEAMLESS STAINLESS STEEL PIPE FOR OIL COUNTRY TUBULAR GOODS AND METHOD OF MANUFACTURING HIGH-STRENGTH SEAMLESS STAINLESS STEEL PIPE

(71) Applicant: JFE STEEL CORPORATION, Tokyo (JP)

(72) Inventors: Kenichiro Eguchi, Tokyo (JP); Yasuhide Ishiguro, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 307 days.

This patent is subject to a terminal disclaimer.

(21) Appl. No.: 16/076,138

(22) PCT Filed: Nov. 2, 2016

(86) PCT No.: PCT/JP2016/004800
§ 371 (c)(1),
(2) Date: Aug. 7, 2018

(87) PCT Pub. No.: WO2017/138050
PCT Pub. Date: Aug. 17, 2017

(65) Prior Publication Data

US 2020/0157646 A1 May 21, 2020

(30) Foreign Application Priority Data

Feb. 8, 2016 (JP) ..... JP2016-021404

(51) Int. Cl.
*C21D 9/08* (2006.01)
*C21D 6/00* (2006.01)
(Continued)

(52) U.S. Cl.
CPC ..... *C21D 9/085* (2013.01); *C21D 6/004* (2013.01); *C21D 6/005* (2013.01); *C21D 6/008* (2013.01);
(Continued)

(58) Field of Classification Search
CPC ..... C21D 9/085; C21D 6/004; C21D 6/005; C21D 6/008; C21D 8/105;
(Continued)

(56) References Cited

U.S. PATENT DOCUMENTS 7,806,993 B2 10/2010 Miyazaki et al.
2006/0243354 A1* 11/2006 Kimura ..... C21D 1/25 148/592
(Continued)

FOREIGN PATENT DOCUMENTS

EP 3225318 A1 10/2017
JP 2005-336595 A 12/2005
(Continued)

OTHER PUBLICATIONS

Feb. 7, 2017 International Search Report issued in International Application No. PCT/JP2016/004800.
(Continued)

*Primary Examiner* — John A Hevey
(74) *Attorney, Agent, or Firm* — Oliff PLC

(57) ABSTRACT

Provided is a high-strength seamless stainless steel pipe for oil country tubular goods which possesses a high strength, excellent low-temperature toughness and excellent corrosion resistance even when the steel pipe has a large wall thickness. The high-strength seamless stainless steel pipe has the composition which contains, by mass %, C: 0.05% or less, Si: 1.0% or less, Mn: 0.1 to 0.5%, P: 0.05% or less, S: less than 0.005%, Cr: more than 15.0% to 19.0% or less, Mo: more than 2.0% to 3.0% or less, Cu: 0.3 to 3.5%, Ni:
(Continued)

3.0% or more and less than 5.0%, W: 0.1 to 3.0%, Nb: 0.07 to 0.5%, V: 0.01 to 0.5%, Al: 0.001 to 0.1%, N: 0.010 to 0.100%, O: 0.01% or less, and Fe and unavoidable impurities as a balance. Nb, Ta, C, N and Cu satisfy a specified formula. The steel pipe has a microstructure which is formed of 45% or more of a tempered martensite phase, 20 to 40% of a ferrite phase, and more than 10% and 25% or less of a residual austenite phase in terms of volume ratio.

17 Claims, 1 Drawing Sheet

(51) Int. Cl.

| | |
|---|---|
| ***C21D 8/10*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.
CPC ..... *C21D 8/105* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/001* (2013.01); *C21D 2211/005* (2013.01); *C21D 2211/008* (2013.01)

(58) Field of Classification Search
CPC ..... C21D 2211/001; C21D 2211/005; C21D 2211/008; C21D 6/007; C21D 1/22; C21D 1/25; C21D 9/08; C22C 38/001; C22C 38/002; C22C 38/005; C22C 38/02; C22C 38/04; C22C 38/06; C22C 38/42; C22C 38/44; C22C 38/46; C22C 38/48; C22C 38/50; C22C 38/52; C22C 38/54; C22C 38/004; C22C 38/008
See application file for complete search history.

(56) References Cited

U.S. PATENT DOCUMENTS

| | | | | |
|---|---|---|---|---|
| 2011/0226378 | A1 | 9/2011 | Kondo et al. | |
| 2015/0101711 | A1 | 4/2015 | Miyata et al. | |
| 2015/0152531 | A1 | 6/2015 | Eguchi et al. | |
| 2015/0315684 | A1* | 11/2015 | Eguchi | C22C 38/54 148/506 |
| 2015/0354022 | A1 | 12/2015 | Eguchi et al. | |
| 2019/0100821 | A1* | 4/2019 | Eguchi | C22C 38/52 |
| 2019/0106775 | A1 | 4/2019 | Nishida et al. | |
| 2019/0177824 | A1 | 6/2019 | Ichikawa et al. | |
| 2019/0177825 | A1 | 6/2019 | Yano et al. | |
| 2019/0296369 | A1 | 9/2019 | Yano et al. | |
| 2019/0305328 | A1 | 10/2019 | Yano et al. | |
| 2019/0368001 | A1* | 12/2019 | Kamo | C22C 38/002 |
| 2019/0376157 | A1* | 12/2019 | Kamo | C22C 38/002 |
| 2020/0002779 | A1 | 1/2020 | Yoshino et al. | |
| 2020/0080181 | A1 | 3/2020 | Ichikawa et al. | |
| 2020/0157646 | A1 | 5/2020 | Eguchi et al. | |
| 2020/0216936 | A1* | 7/2020 | Kamo | C21D 8/10 |

FOREIGN PATENT DOCUMENTS

| | | | | |
|---|---|---|---|---|
| JP | 2008-081793 | A | 4/2008 | |
| JP | 2010-209402 | A | 9/2010 | |
| JP | 2012-149317 | A | 8/2012 | |
| JP | 2015-096648 | A | 5/2015 | |
| JP | 2017031493 | A * | 2/2017 | |
| WO | 2005/017222 | A1 | 2/2005 | |
| WO | 2010/050519 | A1 | 5/2010 | |
| WO | 2010/134498 | A1 | 11/2010 | |
| WO | 2013-146046 | A1 | 10/2013 | |
| WO | 2013/179667 | A1 | 12/2013 | |
| WO | 2014/097628 | A1 | 6/2014 | |
| WO | WO-2014097628 | A1 * | 6/2014 | C21D 6/004 |
| WO | 2014/112353 | A1 | 7/2014 | |

OTHER PUBLICATIONS

Aug. 7, 2020 Office Action issued in U.S. Appl. No. 16/325,577.
Aug. 7, 2020 Office Action issued in U.S. Appl. No. 16/615,883.
Oct. 30, 2018 Extended Search Report issued in European Patent Application No. 16889754.4.
Jan. 22, 2021 Office Action issued in U.S. Appl. No. 16/615,883.
Jan. 22, 2021 Office Action issued in U.S. Appl. No. 16/325,577.
Oct. 28, 2020 Office Action issued in U.S. Appl. No. 16/318,978.

* cited by examiner

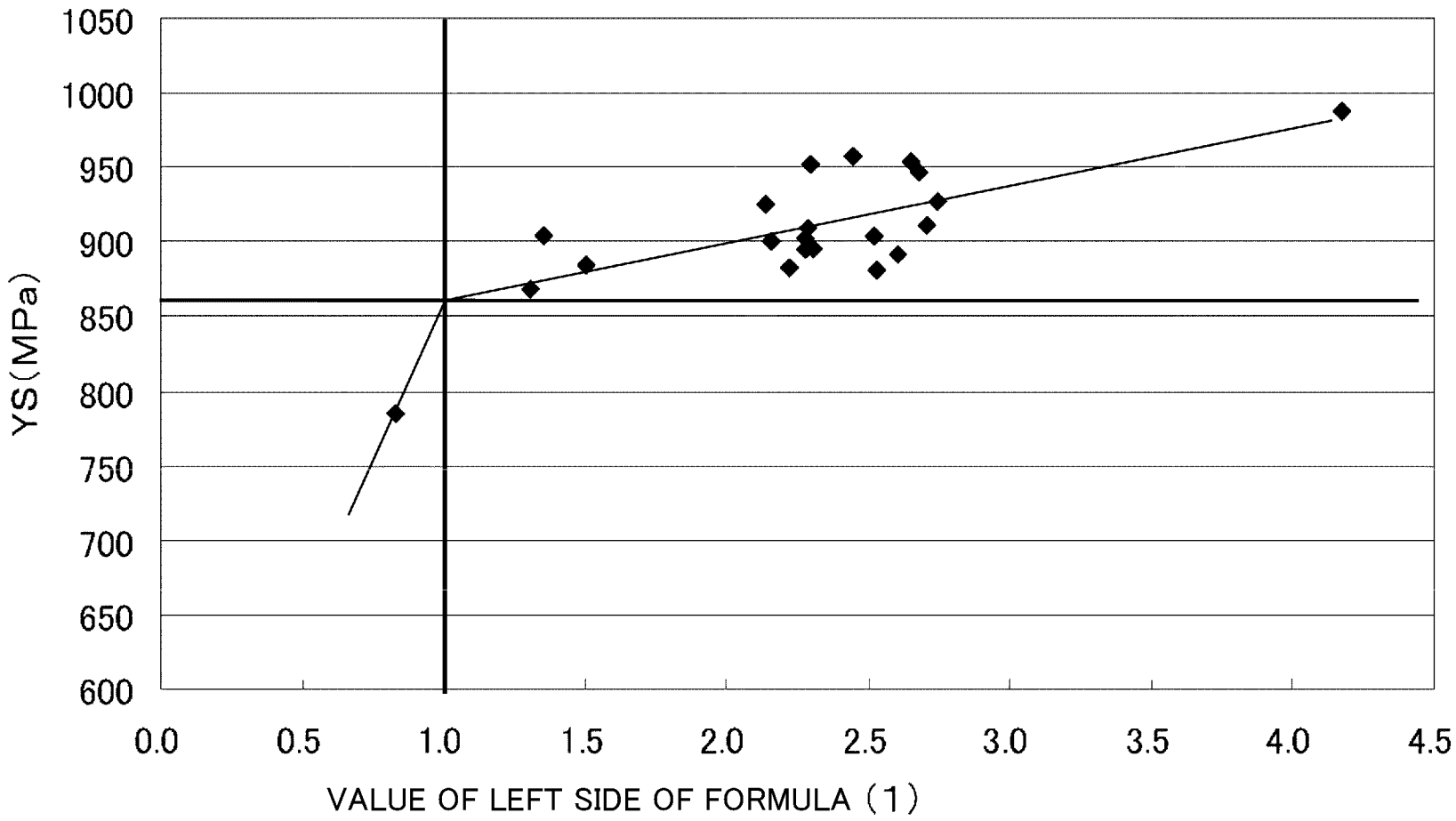
YS(MPa)
1050
1000
950
900
850
800
750
700
650
600
0.0
0.5
1.0
1.5
2.0
2.5
3.0
3.5
4.0
4.5
VALUE OF LEFT SIDE OF FORMULA (1)

HIGH-STRENGTH SEAMLESS STAINLESS STEEL PIPE FOR OIL COUNTRY TUBULAR GOODS AND METHOD OF MANUFACTURING HIGH-STRENGTH SEAMLESS STAINLESS STEEL PIPE

TECHNICAL FIELD

The present disclosure relates to a 17 Cr-based high-strength seamless stainless steel pipe suitably used in oil wells for exploiting crude oil and gas wells for exploiting a natural gas (hereinafter simply referred to as "oil wells") or the like. The present disclosure particularly relates to a high-strength seamless stainless steel pipe which can enhance corrosion resistance and can enhance the low-temperature toughness in a severe corrosive environment containing a carbon dioxide gas ($CO_2$) or chloride ion ($Cl^-$) at a high temperature, an environment containing hydrogen sulfide ($H_2S$) and the like.

BACKGROUND ART

Recently, from a viewpoint of the exhaustion of energy resource anticipated in near future, there has been observed the vigorous development with respect to oil fields having a large depth, oil fields and gas fields in a severe corrosive environment which are in a so-called sour environment containing such as carbon dioxide gas, hydrogen sulfide and the like, which had not been noticed conventionally. In such oil fields and gas fields, a depth of the field is generally extremely deep, and an atmosphere of the field is also a severe corrosive environment having a high temperature and containing $CO_2$ and $Cl^-$ and $H_2S$. Steel pipes for oil country tubular goods used in these environments are required to have both high strength and excellent corrosion resistance.

Conventionally, in oil fields and gas fields in an environment which contains $CO_2$, $Cl^-$ and the like, as a pipe for oil country tubular goods used for drilling, a 13Cr martensitic stainless steel pipe has been generally used. However, recently, the development of oil wells in a corrosive environment at a higher temperature (high temperature up to 200° C.) has been made. In such an environment, there may be a case where the corrosion resistance of 13Cr martensitic stainless steel is insufficient. Accordingly, there has been a demand for a steel pipe for oil country tubular goods having excellent corrosion resistance which can be used even in such an environment.

To satisfy such a demand, for example, PTL 1 discloses a high strength stainless steel pipe for oil country tubular goods having excellent corrosion resistance. The steel pipe has the composition which contains, by mass %, C: 0.005 to 0.05%, Si: 0.05 to 0.5%, Mn: 0.2 to 1.8%, P: 0.03% or less, S: 0.005% or less, Cr: 15.5 to 18%, Ni: 1.5 to 5%, Mo: 1 to 3.5%, V: 0.02 to 0.2%, N: 0.01 to 0.15% and O: 0.006% or less, wherein Cr, Ni, Mo, Cu and C satisfy a specific relationship, and Cr, Mo, Si, C, Mn, Ni, Cu and N satisfy a specific relationship. The steel pipe also has a microstructure which includes a martensite phase as a base phase, and 10 to 60% of a ferrite phase in terms of volume ratio or, further, 30% or less of an austenite phase in terms of volume ratio. With such composition and microstructure, PTL1 describes that it is possible to stably manufacture a stainless steel pipe for oil country tubular goods which exhibits sufficient corrosion resistance even in a severe corrosive environment of high temperature up to 230° C. containing $CO_2$ and $Cl^-$ and having high strength exceeding a yield strength of 654 MPa (95 ksi) and also high toughness.

PTL 2 discloses a high strength stainless steel pipe for oil country tubular goods having high toughness and excellent corrosion resistance. In the technique described in PTL 2, the steel pipe has the composition which contains, by mass %, C: 0.04% or less, Si: 0.50% or less, Mn: 0.20 to 1.80%, P: 0.03% or less, S: 0.005% or less, Cr: 15.5 to 17.5%, Ni: 2.5 to 5.5%, V: 0.20% or less, Mo: 1.5 to 3.5%, W: 0.50 to 3.0%, Al: 0.05% or less, N: 0.15% or less and O: 0.006% or less, wherein Cr, Mo, W and C satisfy a specific relationship, Cr, Mo, W, Si, C, Mn, Cu, Ni and N satisfy a specific relationship, and Mo and W satisfy a specific relationship. The steel pipe also has a microstructure which includes a martensite phase as a base phase, and 10 to 50% of a ferrite phase in terms of volume ratio. With such composition and microstructure, PTL 2 describes that it is possible to stably manufacture a high-strength stainless steel pipe for oil country tubular goods which has high strength where a yield strength exceeds 654 MPa (95 ksi) and exhibits sufficient corrosion resistance even in severe corrosive environment of high temperature containing $CO_2$, $Cl^-$ and $H_2S$.

PTL 3 discloses a high-strength stainless steel pipe having excellent sulfide stress cracking resistance and excellent high-temperature carbon dioxide gas corrosion resistance. In the technique described in PTL 3, the steel pipe has the composition which contains, by mass %, C: 0.05% or less, Si: 1.0% or less, P: 0.05% or less, S: less than 0.002%, Cr: more than 16% to 18% or less, Mo: more than 2% to 3% or less, Cu: 1 to 3.5%, Ni: 3% or more and less than 5% and Al: 0.001 to 0.1%, wherein Mn and N satisfy a specific relationship in a region where Mn: 1% or less and N: 0.05% or less are present. The steel pipe has a microstructure which includes a martensite phase as a base phase, and 10 to 40% of ferrite phase in terms of volume ratio and 10% or less of residual austenite (γ) phase in terms of volume ratio. With such composition and microstructure, PTL 3 describes that it is possible to manufacture a high-strength stainless steel pipe having excellent corrosion resistance which has high strength exceeding a yield strength of 758 MPa (110 ksi), exhibits sufficient corrosion resistance even in a carbon dioxide gas environment of high temperature of 200° C. and exhibits sufficient sulfide stress cracking resistance even when an environment gas temperature is lowered.

PTL 4 discloses a stainless steel pipe for oil country tubular goods. In the technique described in PTL 4, the stainless steel pipe for oil country tubular goods has the composition which contains, by mass %, C: 0.05% or less, Si: 0.5% or less, Mn: 0.01 to 0.5%, P: 0.04% or less, S: 0.01% or less, Cr: more than 16.0% to 18.0%, Ni: more than 4.0% to 5.6%, Mo: 1.6 to 4.0%, Cu: 1.5 to 3.0%, Al: 0.001 to 0.10% and Ni: 0.050% or less, wherein Cr, Cu, Ni and Mo satisfy a specific relationship and, further, (C+N), Mn, Ni, Cu and (Cr+Mo) satisfy a specific relationship. The steel pipe also has a microstructure which includes a martensite phase and 10 to 40% of ferrite phase in terms of volume ratio, a ratio that a plurality of imaginary segments which have a length of 50 μm and are arranged in a row within a range of 200 μm from a surface at pitches of 10 μm in a thickness direction from a surface and the ferrite phase intersect with each other is larger than 85% thus PTL 4 providing a high-strength stainless steel pipe for oil country tubular goods having a 0.2% yield strength of 758 MPa or more. With such composition and microstructure, PTL 4 describes that it is possible to provide a stainless steel pipe for oil country tubular goods having excellent corrosion resistance in a high-temperature environment of 150 to 250° C. and excellent sulfide stress corrosion cracking resistance at a room temperature.

PTL 5 discloses a high-strength stainless steel pipe for oil country tubular goods having high toughness and excellent corrosion resistance. In the technique described in PTL 5, the steel pipe has the composition which contains, by mass %, C: 0.04% or less, Si: 0.50% or less, Mn: 0.20 to 1.80%, P: 0.03% or less, S: 0.005% or less, Cr: 15.5 to 17.5%, Ni: 2.5 to 5.5%, V: 0.20% or less, Mo: 1.5 to 3.5%, W: 0.50 to 3.0%, Al: 0.05% or less, N: 0.15% or less and O: 0.006% or less, wherein Cr, Mo, W and C satisfy a specific relationship, Cr, Mo, W, Si, C, Mn, Cu, Ni and N satisfy a specific relationship, and Mo and W satisfy a specific relationship. The steel pipe also has a microstructure where, with respect to the largest crystal grain, a distance between arbitrary two points in the grain is set to 200 μm or less. The stainless steel pipe has high strength exceeding a yield strength of 654 MPa (95 ksi), has excellent toughness, and exhibits sufficient corrosion resistance in a high-temperature corrosive environment of 170° C. or above containing $CO_2$, $Cl^-$ and $H_2S$.

PTL 6 discloses a high-strength martensitic seamless stainless steel pipe for oil country tubular goods. In the technique described in PTL 6, the seamless steel pipe has the composition which contains, by mass %, C: 0.01% or less, Si: 0.5% or less, Mn: 0.1 to 2.0%, P: 0.03% or less, S: 0.005% or less, Cr: more than 15.5% to 17.5% or less, Ni: 2.5 to 5.5%, Mo: 1.8 to 3.5%, Cu: 0.3 to 3.5%, V: 0.20% or less, Al: 0.05% or less and N: 0.06% or less. The steel pipe has a microstructure which preferably includes 15% or more of ferrite phase or 25% or less of residual austenite phase in terms of volume ratio, and a tempered martensite phase as a balance. In PTL 6, in addition to the above-mentioned components, the composition may further contain W: 0.25 to 2.0% and/or Nb: 0.20% or less. With such composition and microstructure, it is possible to stably manufacture a high-strength martensitic seamless stainless steel pipe for oil country tubular goods having high strength where a yield strength is 655 MPa or more and 862 MPa or less and a tensile characteristic where a yield ratio is 0.90 or more, and having sufficient corrosion resistance (carbon dioxide gas corrosion resistance, sulfide stress corrosion cracking resistance) even in a severe corrosive environment of high temperature of 170° C. or above containing $CO_2$, $Cl^-$ and the like and $H_2S$.

PTL 7 discloses a stainless steel pipe for oil country tubular goods. In the technique described in PTL 7, the stainless steel pipe has the composition which contains, by mass %, C: 0.05% or less, Si: 1.0% or less, Mn: 0.01 to 1.0%, P: 0.05% or less, S: less than 0.002%, Cr: 16 to 18%, Mo: 1.8 to 3%, Cu: 1.0 to 3.5%, Ni: 3.0 to 5.5%, Co: 0.01 to 1.0%, Al: 0.001 to 0.1%, O: 0.05% or less and N: 0.05% or less, wherein Cr, Ni, Mo and Cu satisfy a specific relationship. The stainless steel pipe also has a microstructure which preferably includes 10% or more and less than 60% of a ferrite phase in terms of volume ratio, 10% or less of a residual austenite phase in terms of volume ratio, and 40% or more of a martensite phase in terms of volume ratio. With such composition and microstructure, PTL 7 describes that it is possible to obtain a stainless steel pipe for oil country tubular goods which can stably exhibit high strength where a yield strength is 758 MPa or more and excellent high-temperature corrosion resistance.

CITATION LIST

Patent Literature

PTL 1: JP-A-2005-336595
PTL 2: JP-A-2008-81793
PTL 3: WO 2010/050519
PTL 4: WO 2010/134498
PTL 5: JP-A-2010-209402
PTL 6: JP-A-2012-149317
PTL 7: WO 2013/146046

SUMMARY

Technical Problem

However, along with the recent development of oil fields, gas fields and the like in a severe corrosive environment, steel pipes for oil country tubular goods are required to have high strength where a yield strength is 862 MPa (125 ksi) or more and to maintain excellent corrosion resistance including excellent carbon dioxide gas corrosion resistance, excellent sulfide stress corrosion cracking resistance and excellent sulfide stress cracking resistance together even in a severe corrosive environment of high temperature of 200° C. or above and containing $CO_2$, $Cl^-$ and $H_2S$.

In the techniques described in PTLs 1 to 7, however, besides Cr, large amounts of alloy elements are contained in the steel pipe for ensuring excellent corrosion resistance so that the steel pipe exhibits the microstructure including residual austenite. Accordingly, in the techniques described in PTLs 1 to 7, to ensure high strength where a yield strength is 862 MPa (125 ksi) or more, it is necessary to reduce residual austenite. However, in a method of realizing the acquisition of high strength by reducing residual austenite by making use of the prior art, in the manufacture of a material having a large thickness, a sufficient rolling reduction ratio cannot be ensured so that the microstructure becomes coarse thus giving rise to a drawback that desired excellent low-temperature toughness cannot be acquired.

It is an object of the present disclosure to provide a high-strength seamless stainless steel pipe for oil country tubular goods which can overcome such a drawback of the prior art, and possesses high strength of yield strength being 862 MPa or more, excellent low-temperature toughness and excellent corrosion resistance even when the steel pipe has a large wall thickness, and a method of manufacturing the high-strength seamless stainless steel pipe for oil country tubular goods.

In this specification, "has a large wall thickness" means the case where the steel pipe has a wall thickness of 25.4 mm or more.

In this specification, "excellent low-temperature toughness" means the case where an absorbing energy $vE_{-10}$ in a Charpy impact test at a test temperature of −10° C. is 40 J or more. Also In this specification, "excellent corrosion resistance" is a concept which includes "excellent carbon dioxide gas corrosion resistance", "excellent sulfide stress corrosion cracking resistance" and "excellent sulfide stress cracking resistance".

In this specification, "excellent carbon dioxide gas corrosion resistance" means a state where, when a specimen is immersed in 20 mass % NaCl aqueous solution (solution temperature: 200° C., $CO_2$ gas atmosphere of 30 atmospheric pressure) which is a test solution held in an autoclave, and an immersion period is set to 336 hours, the specimen exhibits a corrosion rate of 0.125 mm/y or below.

In this specification, "excellent sulfide stress corrosion cracking resistance" means a state where, when a specimen is immersed into an aqueous solution whose pH is adjusted to 3.3 by adding an acetic acid and sodium acetate into a test solution held in an autoclave (20 mass % NaCl aqueous solution (solution temperature: 100° C., $CO_2$ gas at 30 atmospheric pressure, $H_2S$ atmosphere of 0.1 atmospheric pressure)), an immersion period is set to 720 hours, and 100% of yield stress is applied to the specimen as a load stress, no crack occurs in the specimen after the test.

In this specification, "excellent sulfide stress cracking resistance" means a state where, when a specimen is immersed into an aqueous solution whose pH is adjusted to 3.5 by adding an acetic acid and sodium acetate into a test solution held in an autoclave (20 mass % NaCl aqueous solution (solution temperature: 25° C., $CO_2$ gas at 0.9 atmospheric pressure, $H_2S$ atmosphere of 0.1 atmospheric pressure)), an immersion period is set to 720 hours, and 90% of yield stress is applied to the specimen as a load stress, no crack occurs in the specimen after the test.

Solution to Problem

To achieve the above-mentioned object, inventors of the present disclosure have made extensive studies on various factors which influence strength and toughness of a seamless steel pipe having 17Cr-based stainless steel composition. As a result of the studies, the inventors have come up with an idea of making use of the increase of strength by precipitation brought about by a Cu precipitate, an Nb precipitate or a Ta precipitate to ensure high strength where a yield strength YS is 862 MPa or more without reducing an amount of residual austenite. The inventors also have found that, to make use of the such increase of strength by precipitation, it is necessary to adjust the contents of C, N, Nb, Ta and Cu such that a following formula (1) is satisfied.

$$5.1\times\{(Nb+0.5Ta)-10^{-2.2}/(C+1.2N)\}+Cu\geq 1.0 \quad (1)$$

(where, Nb, Ta, C, N and Cu: contents (mass %) of respective elements which are expressed as zero when not contained)

To be more specific, the inventors have found that the seamless steel pipe having 17Cr-based stainless steel composition can acquire desired strength and toughness by having specific composition and specific microstructure and by satisfying the above-mentioned formula (1).

The present disclosure has been completed based on such finding and further studies made based on such finding. That is, the disclosed exemplary embodiments are as follows.

[1] A high-strength seamless stainless steel pipe for oil country tubular goods having the composition which contains, by mass %, C: 0.05% or less, Si: 1.0% or less, Mn: 0.1 to 0.5%, P: 0.05% or less, S: less than 0.005%, Cr: more than 15.0% to 19.0% or less, Mo: more than 2.0% to 3.0% or less, Cu: 0.3 to 3.5%, Ni: 3.0% or more and less than 5.0%, W: 0.1 to 3.0%, Nb: 0.07 to 0.5%, V: 0.01 to 0.5%, Al: 0.001 to 0.1%, N: 0.010 to 0.100%, O: 0.01% or less, and Fe and unavoidable impurities as a balance, wherein Nb, Ta, C, N and Cu satisfy a following formula (1), having a microstructure which is formed of 45% or more of a tempered martensite phase, 20 to 40% of a ferrite phase, and more than 10% and 25% or less of a residual austenite phase in terms of a volume ratio, and having a yield strength YS of 862 MPa or more.

$$5.1\times\{(Nb+0.5Ta)-10^{-2.2}/(C+1.2N)\}+Cu\geq 1.0 \quad (1)$$

(where, Nb, Ta, C, N and Cu: contents (mass %) of respective elements which are expressed as zero when not contained)

[2] The high-strength seamless stainless steel pipe for oil country tubular goods described in [1], wherein the above-mentioned composition further contains, by mass %, one kind or two or more kinds selected from a group consisting of Ti: 0.3% or less, B: 0.0050% or less, Zr: 0.2% or less, Co: 1.0% or less, and Ta: 0.1% or less.

[3] The high-strength seamless stainless steel pipe for oil country tubular goods described in [1] or [2], wherein the above-mentioned composition further contains, by mass %, one kind or two kinds selected from a group consisting of Ca: 0.0050% or less and REM: 0.01.% or less.

[4] The high-strength seamless stainless steel pipe for oil country tubular goods described in any one of [1] to [3], wherein the above-mentioned composition further contains, by mass %, one kind or two kinds selected from a group consisting of Mg: 0.01% or less and Sn: 0.2% or less.

[5] A method of manufacturing the high-strength seamless stainless steel pipe for oil country tubular goods described in any one of [1] to [4], the method including the steps of:

heating a steel pipe material at a temperature which falls within a range of from 1100 to 1350° C. and applying hot working to the steel pipe material thus forming a seamless steel pipe having a desired shape; and applying a quenching treatment to the seamless steel pipe after hot working, wherein the seamless steel pipe is reheated to a temperature which falls within a range of from 850 to 1150° C. and the seamless steel pipe is cooled at a cooling rate of equal to or more than that of air cooling until a surface temperature of the seamless steel pipe becomes a cooling stop temperature which is 50° C. or below and above 0° C., and applying a tempering treatment to the seamless steel pipe, wherein the seamless steel pipe is heated at a tempered temperature which falls within a range of from 500 to 650° C.

Advantageous Effects

According to the present disclosure, it is possible to manufacture a high-strength seamless stainless steel pipe for oil country tubular goods which, even when the steel pipe has a wall thickness of 25.4 mm or more, possesses a high strength where a yield strength Ys of 862 MPa or more and excellent low-temperature toughness that an absorbing energy value $vE_{-10}$ in a Charpy impact test at a rest temperature of −10° C. is 40 (J) or more, and also possesses excellent corrosion resistance such as excellent carbon dioxide gas corrosion resistance, excellent sulfide stress corrosion cracking resistance and excellent sulfide stress cracking resistance even in a severe corrosive environment of high temperature of 200° C. or above and containing $CO_2$ and $Cl^-$.

BRIEF DESCRIPTION OF DRAWINGS

FIG. 1 is a graph showing a relationship between a value of the left side of formula (1) and a yield strength YS.

DESCRIPTION OF EMBODIMENTS

A seamless steel pipe according to the present disclosure is a seamless stainless steel pipe for oil country tubular goods having the composition which contains, by mass %, C: 0.05% or less, Si: 1.0% or less, Mn: 0.1 to 0.5%, P: 0.05% or less, S: less than 0.005%, Cr: more than 15.0% to 19.0% or less, Mo: more than 2.0% to 3.0% or less, Cu: 0.3 to 3.5%, Ni: 3.0% or more and less than 5.0%, W: 0.1 to 3.0%, Nb: 0.07 to 0.5%, V: 0.01 to 0.5%, Al: 0.001 to 0.1%, N: 0.010 to 0.100%, O: 0.01% or less, and Fe and unavoidable impurities as a balance, wherein Nb, Ta, C, N and Cu satisfy a following formula (1), and the steel pipe has a microstructure which is formed of 45% or more of a tempered martensite phase, 20 to 40% of a ferrite phase, and more than 10% and 25% or less of a residual austenite phase in terms of a volume ratio.

$$5.1\times\{(Nb+0.5Ta)-10^{-2.2}/(C+1.2N)\}+Cu\geq 1.0 \quad (1)$$

(where, Nb, Ta, C, N and Cu: contents (mass %) of respective elements which are expressed as zero when not contained)

Firstly, the reasons for limiting the contents of respective constitutional elements of the composition of the seamless steel pipe according to the present disclosure are explained. Unless otherwise specified, mass % in the composition is simply indicated by "%" hereinafter.

C: 0.05% or Less

C is an element which is an important element for increasing strength of martensitic stainless steel. In the present disclosure, it is desirable that the content of C be set to 0.010% or more to ensure a predetermined high strength. However, when the content of C exceeds 0.05%, corrosion resistance is deteriorated. Accordingly, the content of C is set to 0.05% or less. The content of C is preferably set to 0.015% or more. The content of C is preferably set to 0.04% or less.

Si: 1.0% or Less

Si is an element which functions as a deoxidizing agent. To acquire such a deoxidizing effect, it is desirable to set the content of Si to 0.005% or more. On the other hand, when the content of Si exceeds 1.0%, hot workability is deteriorated. Accordingly, the content of Si is set to 1.0% or less. The content of Si is preferably set to 0.1% or more. The content of Si is more preferably set to 0.6% or less.

Mn: 0.1 to 0.5%

Mn is an element which increases strength of martensitic stainless steel. To ensure desired strength of martensitic stainless steel, it is necessary to set the content of Mn to 0.1% or more. On the other hand, when the content of Mn exceeds 0.5%, toughness is deteriorated. Accordingly, the content of Mn is set to a value which falls within a range of from 0.1 to 0.5%. The content of Mn is preferably set to 0.4% or less.

P: 0.05% or Less

P is an element which deteriorates corrosion resistances such as carbon dioxide gas corrosion resistance and sulfide stress cracking resistance and hence, in the present disclosure, it is desirable to decrease the content of P as much as possible. However, it is permissible that the content of P is 0.05% or less. Accordingly, the content of P is set to 0.05% or less. The content of P is preferably set to 0.02% or less.

S: Less than 0.005%

S is an element which remarkably deteriorates hot workability and impedes a stable operation of a hot pipe forming step and hence, it is preferable to decrease the content of S as much as possible. However, when the content of S is less than 0.005%, a pipe can be manufactured by taking ordinary steps. Accordingly, the content of S is set to less than 0.005%. The content of S is preferably set to 0.001% or less.

Cr: More than 15.0% to 19.0% or Less

Cr is an element which forms a protective film on a surface of a steel pipe thus contributing to the enhancement of corrosion resistance. When the content of Cr is 15.0% or less, desired corrosion resistance cannot be ensured. Accordingly, it is necessary to set the content of Cr to more than 15.0%. On the other hand, when the content of Cr exceeds 19.0%, a fraction of ferrite becomes excessively high so that desired strength cannot be ensured. Accordingly, the content of Cr is set to more than 15.0% and 19.0% or less. The content of Cr is preferably set to 16.0% or more. The content of Cr is preferably set to 18.0% or less.

Mo: More than 2.0% to 3.0% or Less

Mo is an element which stabilizes a protective film on a surface of a steel pipe thus increasing resistance to pitting corrosion caused by $Cl^-$ and low pH so that Mo enhances sulfide stress cracking resistance and sulfide stress corrosion cracking resistance. To acquire these effects, it is necessary to set the content of Mo to more than 2.0%. On the other hand, Mo is an expensive element and hence, when the content of Mo exceeds 3.0%, a material cost is sharply pushed up and, at the same time, Mo causes deteriorating of toughness and sulfide stress corrosion cracking resistance. Accordingly, the content of Mo is set to a value which falls within a range of from more than 2.0% to 3.0% or less. The content of Mo is preferably set to 2.2% or more. The content of Mo is preferably set to less than 2.8%. The content of Mo is preferably set to 2.7% or less.

Cu: 0.3 to 3.5%

Cu is an element which increases residual austenite and forms a precipitate thus contributing to the enhancement of yield strength YS. Accordingly, Cu is an extremely important element for the acquisition of high strength without deteriorating low-temperature toughness. Further, Cu strengthens a protective film on a surface of a steel pipe thus suppressing the intrusion of hydrogen into steel so that Cu also has an effect of enhancing sulfide stress cracking resistance and sulfide stress corrosion cracking resistance. To acquire these effects, it is necessary to set the content of Cu to 0.3% or more. On the other hand, when the content of Cu exceeds 3.5%, grain boundary precipitation of CuS is brought about so that hot workability is deteriorated. Accordingly, the content of Cu is set to a value which falls within a range of from 0.3 to 3.5%. The content of Cu is preferably set to 0.5% or more. The content of Cu is more preferably set to 1.0% or more. The content of Cu is preferably set to 3.0% or less.

Ni: 3.0% or More and Less than 5.0%

Ni is an element which strengthens a protective film on a surface of a steel pipe thus contributing to the enhancement of corrosion resistance. Ni is also an element which increases strength of steel by strengthening solid solution. These effects become apparent when the content of Ni is 3.0% or more. On the other hand, when the content of Ni is 5.0% or more, stability of a martensitic phase is lowered and hence, strength is lowered. Accordingly, the content of Ni is set to 3.0% or more and less than 5.0%. The content of Ni is preferably set to 3.5% or more. The content of Ni is preferably set to 4.5% or less.

W: 0.1 to 3.0%

W is an important element which contributes to the enhancement of strength of steel and enhances sulfide stress cracking resistance and sulfide stress corrosion cracking resistance by stabilizing a protective film on a surface of a steel pipe. W contained in the steel together with Mo remarkably enhances sulfide stress cracking resistance particularly. To acquire these effects, it is necessary to set the content of W to 0.1% or more. On the other hand, when the content of W exceeds 3.0%, toughness is deteriorated. Accordingly, the content of W is set to a value which falls within a range of from 0.1 to 3.0%. The content of W is preferably set to 0.5% or more. The content of W is more preferably set to 0.8% or more. The content of W is preferably set to 2.0% or less.

Nb: 0.07 to 0.5%

Nb is an element which is bonded with C and N to precipitate in the form of Nb carbon nitride (Nb precipitate)

and Nb contributes to the enhancement of a yield strength YS. Thus, Nb is an important element in the present disclosure. To acquire these effects, it is necessary to set the content of Nb to 0.07% or more. On the other hand, when the content of Nb exceeds 0.5%, toughness and sulfide stress cracking resistance are deteriorated. Accordingly, the content of Nb is set to a value which falls within a range of from 0.07 to 0.5%. The content of Nb is preferably set to a value which falls within a range of from 0.07 to 0.2%.

V: 0.01 to 0.5%

V is an element which is bonded with C and N and precipitates in the form of V carbon nitride (V precipitate) thus contributing to the enhancement of a yield strength YS of steel in addition to the contribution to the enhancement of strength of steel in the form of solid solution. To acquire these effects, it is necessary to set the content of V to 0.01% or more. On the other hand, when the content of V exceeds 0.5%, toughness and sulfide stress cracking resistance are deteriorated. Accordingly, the content of V is set to a value which falls within a range of from 0.01 to 0.5%. The content of V is preferably set to 0.02% or more. The content of V is preferably set to 0.1% or less.

Al: 0.001 to 0.1%

Al is an element which functions as a deoxidizing agent. To acquire such a deoxidizing effect, it is necessary to set the content of Al to 0.001% or more. On the other hand, when the content of Al exceeds 0.1%, an amount of oxide is increased so that cleanliness is lowered whereby toughness is deteriorated. Accordingly, the content of Al is set to a value which falls within a range of from 0.001 to 0.1%. The content of Al is preferably set to 0.01% or more. The content of Al is more preferably set to 0.02% or more. The content of Al is preferably set to 0.07% or less.

N: 0.010 to 0.100%

N is an element which enhances pitting corrosion resistance. To acquire such an effect, it is necessary to set the content of N to 0.010% or more. However, when the content of N exceeds 0.100%, N forms nitride thus deteriorating toughness. Accordingly, the content of N is set to a value which falls within a range of from 0.010 to 0.100%. The content of N is preferably set to 0.02% or more. The content of N is preferably set to 0.06% or less.

O: 0.01% or Less

O (oxygen) is present in steel in the form of an oxide and hence, O adversely affects various properties of the steel. Accordingly, in the present disclosure, it is desirable to decrease the content of O as much as possible. Particularly, when the content of O exceeds 0.01%, hot workability, corrosion resistance and toughness are deteriorated. Accordingly, the content of O is set to 0.01% or less.

Further, in the present disclosure, the contents of Nb, Ta, C, N and Cu respectively fall within the above-mentioned ranges, and are adjusted so as to satisfy a next formula (1).

$$5.1\times\{(Nb+0.5Ta)-10^{-2.2}/(C+1.2N)\}+Cu\geq 1.0 \quad (1)$$

(where, Nb, Ta, C, N and Cu: contents (mass %) of respective elements which are expressed as zero when not contained)

When a value of the left side of the formula (1) is less than 1.0, a precipitation amount of Cu precipitate, a precipitation amount of Nb precipitate and a precipitation amount of Ta precipitate are small so that the increase of strength by precipitation strengthening is insufficient and hence, as shown in in FIG. 1, steel cannot acquire desired strength with certainty. Accordingly, in the present disclosure, the contents of Nb, Ta, C, N and Cu are adjusted such that the value of the left side of the formula (1) becomes 1.0 or more. As described previously, when steel does not contain the element described in the formula (1), the value of the left side of the formula (1) is calculated by setting the content of the element to zero. The value of the left side of the formula (1) is preferably set to 2.0 or more.

In the present disclosure, the balance other than the above-mentioned components is formed of Fe and unavoidable impurities.

In the present disclosure, in addition to the above-mentioned basic composition, the steel may contain, as selective elements, one kind or two or more kinds selected from a group consisting of Ti: 0.3% or less, B: 0.0050% or less, Zr: 0.2% or less, Co: 1.0% or less, and Ta: 0.1% or less. The composition may further contain, as selective elements, one kind or two kinds selected from a group consisting of Ca: 0.0050% or less and REM: 0.01% or less. The composition may still further contain, as selective elements, one kind or two kinds selected from a group consisting of Mg: 0.01% or less and Sn: 0.2% or less.

One kind or two or more kinds selected from a group consisting of Ti: 0.3% or less, B: 0.0050% or less, Zr: 0.2% or less, Co: 1.0% or less, and Ta: 0.1% or less All of Ti, B, Zr, Co and Ta are elements which increase strength of steel, and steel may contain at least one kind of these elements selectively when required. In addition to the above-mentioned strength increasing effect, Ti, B, Zr, Co and Ta also have an effect of improving sulfide stress cracking resistance. Particularly, Ta is an element which brings about an effect substantially equal to an effect of Nb and can replace apart of Nb with Ta. To acquire such an effect, it is desirable that the content of Ti be 0.01% or more, the content of B be 0.0001% or more, the content of Zr be 0.01% or more, the content of Co be 0.01% or more, and the content of Ta be 0.01% or more. On the other hand, when the content of Ti exceeds 0.3%, the content of B exceeds 0.0050%, the content of Zr exceeds 0.2%, the content of Co exceeds 1.0%, and the content of Ta exceeds 0.1%, toughness is deteriorated. Accordingly, when steel contains Ti, B, Zr, Co and Ta, it is preferable that steel contain Ti: 0.3% or less, B: 0.0050% or less, Zr: 0.2% or less, Co: 1.0% or less, and Ta: 0.1% or less.

One kind or two kinds selected from a group consisting of Ca: 0.0050% or less and REM: 0.01% or less Both of Ca and REM are elements which contribute to improvement of sulfide stress corrosion cracking resistance by way of shape control of sulfide, and steel can contain one kind or two kinds of these elements when required. To acquire such an effect, it is desirable to set the content of Ca to 0.0001% or more and the content of REM to 0.001% or more. On the other hand, even when the content of Ca exceeds 0.0050% or the content of REM exceeds 0.01%, the effect is saturated so that an amount of effect which corresponds to the contents of Ca and REM cannot be expected. Accordingly, when steel contains Ca and REM, it is preferable to limit the content of Ca to 0.0050% or less and the content of REM to 0.01% or less respectively.

One Kind or Two Kinds Selected from a Group Consisting of Mg: 0.01% or Less and Sn: 0.2% or Less Both of Mg and Sn are elements which contribute to the enhancement of corrosion resistance, and steel can selectively contain one kind or two kinds of these elements when necessary. To acquire such an effect, it is desirable to set the content of Mg to 0.002% or more and the content of Sn to 0.01% or more. On the other hand, even when the content of Mg exceeds 0.01% or the content of Sn exceeds 0.2%, the effect is saturated so that an amount of effect which corresponds to the contents of Mg and Sn cannot be expected.

Accordingly, when steel contains Mg and Sn, it is preferable to limit the content of Mg to 0.01% or less and the content of Sn to 0.2% or less respectively.

Next, the reason of limiting the microstructure of the seamless steel pipe according to the present disclosure is explained.

The seamless steel pipe according to the present disclosure has the above-mentioned composition, and has the microstructure formed of 45% or more of a tempered martensite phase as a main phase in terms of volume ratio, 20 to 40% of a ferrite phase in terms of volume ratio, and 10% or more and 25% or less of a residual austenite phase in terms of volume ratio.

In the seamless steel pipe according to the present disclosure, to ensure desired strength, the microstructure includes a tempered martensite phase as a main phase. Further, in the present disclosure, at least as a second phase, a ferrite phase is precipitated at a volume ratio of 20% or more. With such precipitation of the ferrite phase, a strain introduced at the time of hot rolling is concentrated on the soft ferrite phase thus preventing the occurrence of flaws. Further, by precipitating the ferrite phase at a volume ratio of 20% or more, the occurrence and propagation of sulfide stress corrosion cracking and sulfide stress cracking can be suppressed and hence, desired corrosion resistance can be ensured. On the other hand, when a precipitation amount of ferrite phase exceeds 40% in terms of volume ratio, there may be a case where the steel pipe cannot ensure desired strength. Accordingly, the content of ferrite phase is set to a value which falls within a range of from 20 to 40% in terms of volume ratio.

Further, in the seamless steel pipe according to the present disclosure, as a second phase, in addition to the ferrite phase, an austenite phase (a residual austenite phase) is also precipitated. Due to the presence of the residual austenite phase, ductility and toughness are enhanced. To acquire such a ductility and toughness enhancing effect while ensuring desired strength, the residual austenite phase is precipitated at a volume ratio of more than 10%. On the other hand, when a large amount of residual austenite phase is precipitated exceeding a volume ratio of 25%, desired strength cannot be ensured. Accordingly, the content of residual austenite phase is set to 25% or less in terms of volume ratio. It is preferable that the content of residual austenite phase is set to 10% or more and 20% or less in terms of volume ratio.

Here, in the present disclosure, with respect to measurement of the above-mentioned microstructure of the seamless steel pipe, specimens for microstructure observation were etched with a Villella reagent (a reagent prepared by mixing a picric acid, a hydrochloric acid and ethanol at ratios of 2 g, 10 ml and 100 ml respectively), the images of microstructures were taken by a scanning electron microscope (magnification: 1000 times), and a fraction of a ferrite phase (volume %) in the microstructure was calculated using an image analyzer.

Then, specimens for X-ray diffraction were ground and polished such that a cross section (C cross section) orthogonal to a pipe axis direction becomes a measurement surface, and an amount of residual austenite (γ) was measured using an X-ray diffraction method. An amount of residual austenite phase (γ) was measured such that diffracted X-ray integral intensities of a (220) plane of γ and a (211) plane of a were measured and conversion was performed using a following relationship $$\gamma \text{ (volume ratio)} = 100/(1+(I\alpha R\gamma/I\gamma R\alpha))$$

(where, Iα: integral intensity of α, Rα: crystallographical theoretic calculation value of α, Iγ: integral intensity of γ, Rγ: crystallographical theoretic calculation value of γ).

A fraction of tempered martensite phase can be calculated as a fraction of a balance other than the ferrite phase and the residual γ phase.

The above-mentioned microstructure of the seamless steel pipe according to the present disclosure can be adjusted by performing heat treatment (quenching treatment and tempering treatment) under particular conditions described later.

As has been described heretofore, the seamless steel pipe according to the present disclosure can acquire desired strength by having the particular composition while satisfying the above-mentioned formula (1) and by adjusting the microstructure of the seamless steel pipe such that the microstructure is formed of 45% or more of a tempered martensite phase, 20 to 40% of a ferrite phase, and more than 10% and 25% or less of a residual austenite phase.

Next, a preferred method of manufacturing a seamless stainless steel pipe according to the present disclosure is explained.

In the present disclosure, a seamless steel pipe for oil country tubular goods is manufactured by: heating a starting material (a steel pipe material) at a temperature which falls within a range of from 1100 to 1350° C. and applying hot working to the steel raw material thus forming a seamless steel pipe having a predetermined shape; and applying hardening to the seamless steel pipe after hot working, wherein the seamless steel pipe is reheated to a temperature which falls within a range of from 850 to 1150° C. and the seamless steel pipe is cooled at a cooling rate of equal to or more than that of air cooling until a surface temperature of the seamless steel pipe becomes a temperature which is 50° C. or below and above 0° C.; and applying tempering to the seamless steel pipe for heating the seamless steel pipe at a temperature which falls within a range of from 500 to 650° C.

In the present disclosure, the steel pipe material having the above-mentioned composition is used as a starting material.

A method of manufacturing the starting material is not particularly limited, and any one of usually known methods of manufacturing a steel pipe material can be used. It is preferable to adopt a method where molten steel having the above-mentioned composition is made by a usual molten steel making method which uses a converter or the like, and the molten steel can be formed into cast block (steel block) such as billets by a usual casting method such as a continuous casting method. It is needless to say that the method of manufacturing the starting material is not limited to the above methods. Further, no problem arises in using, as a steel pipe material, a steel block having a desired size and a desired shape which is prepared by applying additional hot rolling to a cast block.

Then, these steel pipe materials are heated.

In the heating step, a heating temperature is set to a temperature which falls within a range of from 1100 to 1350° C. When the heating temperature is below 1100° C., hot workability is deteriorated and hence, flaws are frequently formed on a seamless steel pipe during pipe forming in the following step. On the other hand, when the heating temperature becomes a high temperature exceeding 1350° C., crystal grains become coarse thus deteriorating low-temperature toughness. Accordingly, a heating temperature in the heating step is set to a temperature which falls within a range of from 1100 to 1350° C.

Next, hot working is applied to the heated steel pipe materials in a hot pipe forming step so that seamless steel pipes having predetermined shapes are formed. As the hot pipe forming step, it is desirable to use a hot pipe forming step of a Mannesmann-plug mill type or a Mannesmann-mandrel mill type. However, a seamless steel pipe may be formed by hot extrusion using a press. Further, in the hot pipe forming step, it is sufficient that only a seamless steel pipe having a predetermined size can be manufactured and hence, it is not necessary to set any particular conditions of hot pipe forming, and any usual manufacturing conditions are applicable.

Cooling treatment may be performed after the hot pipe forming step. It is not necessary to particularly limit the cooling condition in the cooling step. Provided that a seamless steel pipe has the composition which falls within the composition range according to the present disclosure, it is possible to obtain the microstructure of the steel pipe such that the microstructure contains a martensite phase as a main phase by cooling the steel pipe to a room temperature at a cooling rate of approximately air cooling after hot working.

In the present disclosure, heat treatment including quenching treatment and tempering treatment is further performed after such cooling treatment.

In the quenching treatment, the seamless steel pipe which is cooled in the cooling step is reheated to a temperature which falls within a range of from 850 to 1150° C. and, thereafter, a surface temperature of the steel pipe is cooled to a cooling stop temperature of 50° C. or below and above 0° C. at a cooling rate of air cooling or more. When the heating temperature of quenching treatment is below 850° C., the reverse transformation from martensite to austenite does not occur and the transformation from austenite to martensite does not occur during cooling so that the steel pipe cannot acquire desired strength with certainty. On the other hand, when the heating temperature is excessively high exceeding 1150° C., crystal grains of the steel become coarse. Accordingly, a heating temperature in quenching treatment is set to a temperature which falls within a range of from 850 to 1150° C. It is preferable to set a heating temperature in quenching treatment to 900° C. or above. It is preferable to set a heating temperature in quenching treatment to 1000° C. or below.

When a cooling stop temperature exceeds 50° C., the transformation from austenite to martensite does not occur sufficiently so that a fraction of austenite becomes excessively large. On the other hand, when the cooling stop temperature is 0° C. or below, the transformation to martensite excessively occurs so that a necessary fraction of austenite cannot be acquired. Accordingly, in the present disclosure, in quenching treatment, a cooling stop temperature in cooling in is set to 50° C. or below and above 0° C.

In this specification, "cooling rate of air cooling or more" is 0.01° C./s or more.

In quenching treatment, it is desirable to set a soaking period to 5 to 30 minutes for making a temperature in a wall thickness direction uniform and for preventing variations in material property.

In tempering treatment, a seamless steel pipe to which quenching treatment is applied is heated at a tempering temperature of 500 to 650° C. and, thereafter, the seamless steel pipe can be cooled by natural cooling. When the tempering temperature is below 500° C., the tempering temperature is excessively low so that there may be a concern that a desired tempering effect cannot be expected. On the other hand, when the tempering temperature is excessively high exceeding 650° C., a martensite phase as hardened is formed so that there is a concern that a seamless steel pipe cannot satisfy desired high strength and desired high toughness as well as excellent corrosion resistance simultaneously. Accordingly, a tempering temperature is set to a temperature which falls within a range of from 500 to 650° C. It is preferable to set a tempering temperature to 520° C. or above. It is preferable to set a tempering temperature to 630° C. or below.

In tempering treatment, it is desirable to set a holding time to 5 to 90 minutes for making a temperature in a wall thickness direction uniform and for preventing variations in material property.

By applying the above-mentioned heat treatment (quenching treatment and tempering treatment) to a seamless steel pipe, the microstructure of the seamless steel pipe is formed into a microstructure which includes a tempered martensite phase, a ferrite phase and a residual austenite phase where the tempered martensite phase forms a main phase. With this, it is possible to provide a high-strength seamless stainless steel pipe for oil country tubular goods which has desired high strength, desired high toughness and excellent corrosion resistance.

A yield strength YS of a high-strength seamless stainless steel pipe for oil country tubular goods acquired by the present disclosure is 862 MPa or more, and has excellent low-temperature toughness and excellent corrosion resistance. It is preferable that the high-strength seamless stainless steel pipe for oil country tubular goods has a yield strength YS of 1034 MPa or less.

EXAMPLES

Hereinafter, the present disclosure is further described based on exemplary examples.

Molten steel having the composition shown in Table 1 was made by a converter, and the molten steel was cast into billets (cast blocks: steel pipe materials) by a continuous casting method. Heat treatment was applied to the obtained steel pipe materials for heating the steel pipe materials up to 1250° C.

Hot working was applied to the heated steel pipe materials using a seamless pipe mill so that seamless steel pipes (outer diameter: 297 mmϕ, wall thickness: 34 mm) were formed. The seamless steel pipes were cooled to a room temperature (25° C.) by air cooling.

Next, test samples were cut out from the obtained seamless steel pipes. The test samples were subjected to: a quenching treatment where the test samples were reheated to heating temperatures shown in Table 2 and were cooled by water cooling; and then a tempering treatment where the resultant test samples were heated to tempering temperatures shown in Table 2 and were then cooled by air cooling (natural cooling). A cooling rate by water cooling in the quenching treatment was 11° C./s and a cooling rate by air cooling (natural cooling) in the tempering treatment was 0.04° C./s.

Then, specimens were cut out from the obtained heat treated test samples (seamless steel pipes), and a microstructure observation, a tensile test, an impact test, and a corrosion resistance test were performed. The testing methods were as follows.

(1) Microstructure Observation

Specimens for microstructure observation were cut out from the obtained heat treated test samples such that a cross section in a pipe axis direction became an observation surface. The obtained specimens for microstructure observation were etched with a Villella reagent (a reagent prepared by mixing a picric acid, a hydrochloric acid and ethanol at ratios of 2 g, 10 ml and 100 ml respectively). The images of microstructures were taken by a scanning electron microscope (magnification: 1000 times), and a fraction of ferrite phase (volume %) was calculated using an image analyzer.

Further, from the obtained heat treated test samples, specimens for X-ray diffraction were cut out and were ground and polished such that a cross section orthogonal to the pipe axis direction (C cross section) corresponded to a measurement surface, and an amount of residual austenite (γ) was measured using an X-ray diffraction method. That is, an amount of residual austenite (γ) was measured such that, diffracted X-ray integral intensities of a (220) plane of γ and a (211) plane of a were measured and conversion was performed using the following relationship $$\gamma \text{ (volume ratio)}=100/(1+(I\alpha R\gamma/I\gamma R\alpha))$$

(where, Iα is integral intensity of α, Rα is crystallographical theoretic calculation value of α, Iγ is integral intensity of γ, Rγ is crystallographical theoretic calculation value of γ). A fraction of tempered martensite phase was calculated as a balance other than a ferrite phase and a residual γ phase.

(2) Tensile Test

API (American Petroleum Institute) arch-shaped tensile test specimens were obtained from the obtained heat treated test samples such that the pipe-axis direction was aligned with the tensile direction. The tensile test was performed in accordance with the regulation stipulated in API, and tensile properties (yield strength YS, tensile strength TS) were obtained. The test specimens having a high yield strength YS of 862 MPa or more were determined to be pass, and the test specimens having a low yield strength YS of less than 862 MPa were determined to be rejection.

(3) Impact Test

In accordance with the provision stipulated in JIS Z 2242, V-notched specimens (thickness of 10 mm) were obtained from the obtained heat treated test samples such that a longitudinal direction of the specimen was aligned with a pipe-axis direction, and a Charpy impact test was performed. A test temperature was set to −10° C., and an absorbing energy value $vE_{-10}$ at −10° C. was obtained, and toughness was evaluated. Three specimens were used in each test, and an arithmetic mean of the obtained values was set as an absorbing energy value (J) of the high-strength seamless stainless steel pipe. The specimens which exhibited the absorbing energy value $vE_{-10}$ of 40 J or more at a temperature of −10° C. were regarded as high toughness and determined to be pass. The specimens which exhibited the absorbing energy value $vE_{-10}$ of less than 40 J at a temperature of −10° C. were determined to be rejection.

(4) Corrosion Resistance Test

Specimens for corrosion test having a thickness of 3 mm, a width of 30 mm and a length of 40 mm were prepared from the obtained heat-treated test samples by machining, a corrosion test was performed, and carbon dioxide gas corrosion resistance was evaluated.

The corrosion test was performed by immersing the above-mentioned specimen for corrosion test in a test solution held in an autoclave, the test solution being 20 mass % NaCl aqueous solution (solution temperature: 200° C., $CO_2$ gas atmosphere: 30 atmospheric pressure), and by setting an immersion period to 14 days (336 hours). A weight of the specimen for corrosion test was measured after the corrosion test, and a corrosion rate was calculated from the reduction of the weight of the specimen before and after the corrosion test. The specimen which exhibited a corrosion rate of 0.125 mm/y or less was determined to be pass, and the specimen which exhibited a corrosion rate of more than 0.125 mm/y was determined to be rejection.

With respect to the specimens for corrosion test which were already subjected to the corrosion test, the presence or non-presence of the occurrence of pitting on a surface of the specimen for corrosion test was observed using a loupe having the magnification of 10 times. It was determined that pitting was present when pitting having a diameter of 0.2 mm or more was observed. The specimen in which pitting was not present was determined to be pass, and the specimen in which pitting was present was determined to be rejection.

Round rod specimens (diameter: 6.4 mmϕ) were prepared from the obtained test samples by machining, and the specimens were subjected to a sulfide stress cracking resistance test (SSC (Sulfide Stress Cracking) resistance test) in accordance with NACE (National Association of Corrosion and Engineerings) TM0177 Method A.

4-point bending specimens having a thickness of 3 mm, a width of 15 mm and a length of 115 mm were prepared by machining from the obtained test samples, and the specimens were subjected to a sulfide stress corrosion cracking resistance test (SCC (Sulfide Stress Corrosion Cracking) resistance test) in accordance with EFC (European Federation of Corrosion) 17.

The SCC resistance test was performed such that specimens were immersed into an aqueous solution whose pH was adjusted to 3.3 by adding an acetic acid and sodium acetate into a test solution (20 mass % NaCl aqueous solution (solution temperature: 100° C., $H_2S$ of 0.1 atmospheric pressure, $CO_2$ of 30 atmospheric pressure)) held in an autoclave, an immersion period was set to 720 hours, and 100% of yield stress was applied as a load stress. With respect to the specimens after the SCC resistance test, the presence or non-presence of cracking was observed. The specimen in which cracking was not present was determined to be pass, and the specimen in which cracking was present was determined to be rejection.

The SSC resistance test was performed such that specimens were immersed into an aqueous solution whose pH was adjusted to 3.5 by adding an acetic acid and sodium acetate into a test solution (20 mass % NaCl aqueous solution (solution temperature: 25° C., $H_2S$ of 0.1 atmospheric pressure, $CO_2$ of 0.9 atmospheric pressure)) held in an autoclave, an immersion period was set to 720 hours, and 90% of yield stress was applied as a load stress. With respect to the specimens after the SSC resistance test, the presence or non-presence of cracking was observed. The specimen in which cracking was not present was determined to be pass, and the specimen in which cracking was present was determined to be rejection.

The obtained results are shown in Table 3. FIG. 1 shows the result of Table 3 with a relationship between a value of the left side of the formula (1) and a yield strength YS. Here, when the microstructure of the steel pipe does not fall within a range where a volume ratio of a tempered martensite phase is 45% or more, a volume ratio of a ferrite phase is 20 to 40%, and a volume ratio of a residual austenite phase is more than 10% and 25% or less, the relationship in such a microstructure is excluded from the drawing. By setting values in the formula (1) to predetermined values or more, the steel pipe can acquire a high strength where a yield strength YS is 862 MPa or more while maintaining favorable low-temperature toughness with a residual γ amount exceeding 10%. The formula (1) can be expressed by a following formula.

$$5.1\times\{(Nb+0.5Ta)-10^{-2.2}/(C+1.2N)\}+Cu\geq 1.0 \quad (1)$$

(where, Nb, Ta, C, N and Cu: contents (mass %) of respective elements which are expressed as zero when not contained)

TABLE 1

| Steel | Composition (mass %) | | | | | | | | | | | | | | | | | | Formula (1)* | | |
|---|---|---|---|---|---|---|---|---|---|---|---|---|---|---|---|---|---|---|---|---|---|
| No. | C | Si | Mn | P | S | Cr | Mo | Cu | Ni | W | Nb | V | Al | N | O | Ti, B, Zr, Co, Ta | Ca, REM | Mg, Sn | Value of left side | Whether or not formula (1) was satisfied | Remarks |
| A | 0.037 | 0.25 | 0.30 | 0.015 | 0.0009 | 16.4 | 2.4 | 2.1 | 3.8 | 1.2 | 0.10 | 0.06 | 0.039 | 0.050 | 0.0025 | — | — | — | 2.3 | satisfied: ○ | Inventive example |
| B | 0.034 | 0.26 | 0.30 | 0.014 | 0.0012 | 16.4 | 2.4 | 2.5 | 3.7 | 1.2 | 0.10 | 0.06 | 0.036 | 0.052 | 0.0029 | — | — | — | 2.7 | satisfied: ○ | Inventive example |
| C | 0.038 | 0.25 | 0.30 | 0.015 | 0.0009 | 16.4 | 2.4 | 1.0 | 3.9 | 1.0 | 0.13 | 0.06 | 0.039 | 0.055 | 0.0025 | — | — | — | 1.4 | satisfied: ○ | Inventive example |
| D | 0.032 | 0.26 | 0.30 | 0.016 | 0.0011 | 16.6 | 2.5 | 1.0 | 4.0 | 1.0 | 0.17 | 0.06 | 0.036 | 0.047 | 0.0047 | — | — | — | 1.5 | satisfied: ○ | Inventive example |
| E | 0.031 | 0.26 | 0.30 | 0.015 | 0.0007 | 16.5 | 2.5 | 2.5 | 3.7 | 0.9 | 0.09 | 0.05 | 0.039 | 0.049 | 0.0028 | — | — | — | 2.6 | satisfied: ○ | Inventive example |
| F | 0.029 | 0.25 | 0.30 | 0.015 | 0.0009 | 16.5 | 2.4 | 1.0 | 3.9 | 1.0 | 0.13 | 0.06 | 0.045 | 0.052 | 0.0030 | — | — | — | 1.3 | satisfied: ○ | Inventive example |
| G | 0.032 | 0.2S | 0.30 | 0.014 | 0.0014 | 16.4 | 2.4 | 2.0 | 3.8 | 1.2 | 0.17 | 0.06 | 0.047 | 0.050 | 0.0021 | — | — | — | 2.5 | satisfied: ○ | Inventive example |
| H | 0.022 | 0.26 | 0.30 | 0.016 | 0.0010 | 16.4 | 2.4 | 2.5 | 3.8 | 1.2 | 0.13 | 0.06 | 0.050 | 0.034 | 0.0029 | — | — | — | 2.7 | satisfied: ○ | Inventive example |
| I | 0.020 | 0.26 | 0.30 | 0.015 | 0.0008 | 16.5 | 2.4 | 2.0 | 3.7 | 1.2 | 0.13 | 0.06 | 0.041 | 0.059 | 0.0018 | — | — | — | 2.3 | satisfied: ○ | Inventive example |
| J | 0.032 | 0.26 | 0.30 | 0.015 | 0.0011 | 16.6 | 2.4 | 2.0 | 3.8 | 1.2 | 0.13 | 0.06 | 0.045 | 0.034 | 0.0013 | — | — | — | 2.2 | satisfied: ○ | Inventive example |
| K | 0.024 | 0.26 | 0.30 | 0.015 | 0.0011 | 16.5 | 2.4 | 2.0 | 3.7 | 1.2 | 0.10 | 0.06 | 0.038 | 0.055 | 0.0029 | — | — | — | 2.2 | satisfied: ○ | Inventive example |
| L | 0.022 | 0.26 | 0.30 | 0.015 | 0.0007 | 16.6 | 2.4 | 2.6 | 3.7 | 1.2 | 0.10 | 0.06 | 0.049 | 0.048 | 0.0021 | — | — | — | 2.7 | satisfied: ○ | Inventive example |
| M | 0.021 | 0.25 | 0.30 | 0.015 | 0.0012 | 16.5 | 2.4 | 2.5 | 3.7 | 1.2 | 0.10 | 0.06 | 0.041 | 0.038 | 0.0026 | — | — | — | 2.5 | satisfied: ○ | Inventive example |
| N | 0.042 | 0.27 | 0.30 | 0.015 | 0.0009 | 15.6 | 2.3 | 2.0 | 3.5 | 1.1 | 0.11 | 0.06 | 0.034 | 0.044 | 0.0022 | Ti: 0.01, B: 0.0019, Zr: 0.027, Co: 0.08, Ta: 0.025 | Ca: 0.0028, REM: 0.007 | — | 2.3 | satisfied: ○ | Inventive example |
| O | 0.020 | 0.29 | 0.30 | 0.015 | 0.0007 | 18.2 | 2.1 | 2.6 | 3.2 | 0.1 | 0.10 | 0.06 | 0.048 | 0.024 | 0.0025 | — | — | — | 2.5 | satisfied: ○ | Inventive example |
| P | 0.010 | 0.24 | 0.32 | 0.016 | 0.0007 | 16.3 | 2.2 | 2.8 | 4.6 | 1.3 | 0.08 | 0.05 | 0.047 | 0.021 | 0.0018 | — | — | — | 2.3 | satisfied: ○ | Inventive example |
| Q | 0.023 | 0.26 | 0.28 | 0.016 | 0.0007 | 16.4 | 2.6 | 2.7 | 3.8 | 2.5 | 0.10 | 0.06 | 0.044 | 0.039 | 0.0017 | — | — | — | 2.7 | satisfied: ○ | Inventive example |
| R | 0.020 | 0.24 | 0.32 | 0.014 | 0.0006 | 17.0 | 2.2 | 2.5 | 4.6 | 1.1 | 0.42 | 0.06 | 0.051 | 0.040 | 0.0019 | — | — | — | 4.2 | satisfied: ○ | Inventive example |
| S | 0.023 | 0.28 | 0.33 | 0.016 | 0.0007 | 16.4 | 2.4 | 2.3 | 3.3 | 1.2 | 0.08 | 0.06 | 0.047 | 0.043 | 0.0020 | Ti: 0.01, B: 0.0016, Co: 0.09 | Ca: 0.0028, REM: 0.008 | — | 2.3 | satisfied: ○ | Inventive example |
| T | 0.035 | 0.26 | 0.30 | 0.016 | 0.0009 | 16.5 | 2.5 | 2.0 | 3.9 | 1.2 | 0.09 | 0.05 | 0.040 | 0.054 | 0.0028 | — | — | Mg: 0.0053, Sn: 0.11 | 2.1 | satisfied: ○ | Inventive example |
| U | 0.034 | 0.26 | 0.28 | 0.02 | 0.0009 | 16.2 | 2.5 | 2.0 | 3.7 | 1.1 | 0.10 | 0.05 | 0.035 | 0.052 | 0.0023 | — | Ca: 0.0026 | — | 2.2 | satisfied: ○ | Inventive example |
| V | 0.039 | 0.23 | 0.31 | 0.02 | 0.0009 | 16.5 | 2.4 | 2.1 | 3.7 | 1.2 | 0.09 | 0.07 | 0.035 | 0.046 | 0.0027 | Ti: 0.011 | — | — | 2.2 | satisfied: ○ | Inventive |

TABLE 1-continued

| Steel No. | Composition (mass %) C | Si | Mn | P | S | Cr | Mo | Cu | Ni | W | Nb | V | Al | N | O | Ti, B, Zr, Co, Ta | Ca, REM | Mg, Sn | Formula (1)* Value of left side | Whether or not formula (1) was satisfied | Remarks |
|---|---|---|---|---|---|---|---|---|---|---|---|---|---|---|---|---|---|---|---|---|---|
| | | | | | | | | | | | | | | | | | | | | | example |
| W | 0.030 | 0.24 | 0.26 | 0.02 | 0.0009 | 16.4 | 2.3 | 2.2 | 3.9 | 1.2 | 0.10 | 0.06 | 0.042 | 0.059 | 0.0025 | Ti: 0.011 | Ca: 0.0023 | Mg: 0.0061 | 2.4 | satisfied: ○ | Inventive example |
| X | 0.019 | 0.29 | 0.20 | 0.012 | 0.0007 | 16.4 | 2.7 | 2.5 | 4.8 | — | — | 0.06 | 0.040 | 0.011 | 0.0019 | — | Ca: 0.0014 | — | 1.5 | satisfied: ○ | Comparison example |
| Y | 0.010 | 0.27 | 0.10 | 0.016 | 0.0006 | 16.7 | 2.7 | 2.4 | 4.8 | — | — | 0.01 | 0.052 | 0.006 | 0.0018 | Ti: 0.006 | — | — | 0.5 | Not satisfied X | Comparison example |
| Z | 0.020 | 0.21 | 0.27 | 0.011 | 0.0011 | 16.7 | 2.7 | 0.9 | 3.8 | 0.8 | 0.07 | 0.05 | 0.009 | 0.046 | 0.0020 | — | — | — | 0.8 | Not satisfied X | Comparison example |
| AA | 0.020 | 0.24 | 0.26 | 0.011 | 0.0020 | 16.2 | 3.3 | 0.6 | 4.7 | 1.0 | 0.06 | 0.04 | 0.010 | 0.065 | 0.0024 | — | — | — | 0.6 | Not satisfied X | Comparison example |
| AB | 0.010 | 0.26 | 0.27 | 0.010 | 0.0010 | 16.1 | 2.2 | 0.9 | 3.7 | 1.8 | 0.06 | 0.06 | 0.010 | 0.053 | 0.0035 | — | — | — | 0.8 | Not satisfied X | Comparison example |
| AC | 0.023 | 0.27 | 0.28 | 0.015 | 0.0006 | 19.5 | 1.5 | 2.6 | 3.2 | 0.1 | 0.08 | 0.06 | 0.048 | 0.022 | 0.0024 | — | — | — | 2.4 | satisfied: ○ | Comparison example |
| AD | 0.025 | 0.25 | 0.30 | 0.014 | 0.0007 | 14.5 | 2.4 | 3.9 | 3.5 | 2.6 | 0.11 | 0.06 | 0.050 | 0.058 | 0.0025 | — | — | — | 4.1 | satisfied: ○ | Comparison example |
| AE | 0.022 | 0.27 | 0.28 | 0.015 | 0.0006 | 17.3 | 3.6 | 2.6 | 5.3 | 1.1 | 0.36 | 0.05 | 0.053 | 0.048 | 0.0022 | — | — | — | 4.0 | satisfied: ○ | Comparison example |
| AF | 0.018 | 0.28 | 0.30 | 0.016 | 0.0007 | 18.4 | 2.0 | 0.2 | 2.6 | 0.1 | 0.09 | 0.07 | 0.046 | 0.022 | 0.0023 | — | — | — | −0.1 | Not satisfied X | Comparison example |
| AG | 0.034 | 0.23 | 0.28 | 0.014 | 0.0009 | 16.3 | 2.4 | 0.2 | 4.0 | 1.0 | 0.20 | 0.05 | 0.044 | 0.100 | 0.0025 | — | — | — | 1.0 | satisfied: ○ | Comparison example |
| AH | 0.032 | 0.25 | 0.29 | 0.014 | 0.0010 | 16.4 | 2.4 | 1.3 | 3.8 | 1.0 | 0.06 | 0.05 | 0.048 | 0.047 | 0.0026 | — | — | — | 1.2 | satisfied: ○ | Comparison example |
| AI | 0.029 | 0.27 | 0.29 | 0.014 | 0.0009 | 16.8 | 2.5 | 0.7 | 3.7 | 1.0 | 0.10 | 0.05 | 0.041 | 0.046 | 0.0029 | — | — | — | 0.8 | satisfied: ○ | Comparison example |

— The balance other than the above-mentioned components is formed of Fe and unavoidable impurities.

*$5.1 \times \{(Nb + 0.5Ta) - 10 - 2.2/(C + 1.2N)\} + Cu \geq 1.0$ . . . (1)

TABLE 2

| | | Heat treatment | | | | | | |
|---|---|---|---|---|---|---|---|---|
| | | Quenching treatment | | | | Tempering treatment | | |
| Steel pipe No. | Steel No. | Heating temperature (° C.) | Soaking period (minutes) | Cooling | Cooling stop temperature (° C.) | Tempering temperature (° C.) | Holding time (minutes) | Cooling |
| 1 | A | 960 | 20 | water cooling | 35 | 525 | 30 | air cooling |
| 2 | B | 960 | 20 | water cooling | 29 | 550 | 30 | air cooling |
| 3 | C | 960 | 20 | water cooling | 33 | 550 | 30 | air cooling |
| 4 | D | 960 | 20 | water cooling | 34 | 550 | 30 | air cooling |
| 5 | E | 960 | 20 | water cooling | 29 | 550 | 30 | air cooling |
| 6 | F | 960 | 20 | water cooling | 28 | 550 | 30 | air cooling |
| 7 | G | 960 | 20 | water cooling | 33 | 575 | 30 | air cooling |
| 8 | H | 960 | 20 | water cooling | 34 | 575 | 30 | air cooling |
| 9 | I | 960 | 20 | water cooling | 31 | 575 | 30 | air cooling |
| 10 | J | 960 | 20 | water cooling | 34 | 550 | 30 | air cooling |
| 11 | K | 960 | 20 | water cooling | 31 | 550 | 30 | air cooling |
| 12 | L | 960 | 20 | water cooling | 25 | 550 | 30 | air cooling |
| 13 | M | 960 | 20 | water cooling | 31 | 600 | 30 | air cooling |
| 14 | N | 960 | 20 | water cooling | 33 | 525 | 30 | air cooling |
| 15 | O | 960 | 20 | water cooling | 35 | 550 | 30 | air cooling |
| 16 | P | 960 | 20 | water cooling | 30 | 550 | 30 | air cooling |
| 17 | Q | 960 | 20 | water cooling | 31 | 550 | 30 | air cooling |
| 18 | R | 960 | 20 | water cooling | 34 | 550 | 30 | air cooling |
| 19 | S | 960 | 20 | water cooling | 35 | 550 | 30 | air cooling |
| 20 | T | 960 | 20 | water cooling | 36 | 525 | 30 | air cooling |
| 21 | U | 960 | 20 | water cooling | 35 | 525 | 30 | air cooling |
| 22 | V | 960 | 20 | water cooling | 35 | 525 | 30 | air cooling |
| 23 | W | 960 | 20 | water cooling | 35 | 525 | 30 | air cooling |
| 24 | X | 960 | 20 | water cooling | 32 | 550 | 30 | air cooling |
| 25 | Y | 980 | 20 | water cooling | 32 | 575 | 30 | air cooling |
| 26 | Z | 920 | 20 | water cooling | 33 | 600 | 30 | air cooling |
| 27 | AA | 920 | 20 | water cooling | 31 | 600 | 30 | air cooling |
| 28 | AB | 920 | 20 | water cooling | 25 | 600 | 30 | air cooling |
| 29 | AC | 960 | 20 | water cooling | 28 | 550 | 30 | air cooling |
| 30 | AD | 960 | 20 | water cooling | 30 | 550 | 30 | air cooling |
| 31 | AE | 960 | 20 | water cooling | 26 | 550 | 30 | air cooling |
| 32 | AF | 960 | 20 | water cooling | 26 | 550 | 30 | air cooling |
| 33 | M | 960 | 20 | water cooling | 0 | 600 | 30 | air cooling |
| 34 | AG | 960 | 20 | water cooling | 29 | 550 | 30 | air cooling |
| 35 | AH | 960 | 20 | water cooling | 28 | 550 | 30 | air cooling |
| 36 | AI | 960 | 20 | water cooling | 26 | 550 | 30 | air cooling |

TABLE 3

| Steel pipe No | Steel No. | Kind* | Microstructure: TM phase volume ratio (%) | Microstructure: F phase volume ratio (%) | Microstructure: Residual γ phase volume ratio (%) | Tensile property: Yield strength YS (MPa) | Tensile property: Tensile strength TS (MPa) | Toughness $vE_{-10}$ (J) | Corrosion test: Corrosion rate (mm/y) | Corrosion test: Presence or non-presence of pitting | SSC resistance test: Presence or non-presence of cracking | SCC resistance test: Presence or non-presence of cracking | Remarks |
|---|---|---|---|---|---|---|---|---|---|---|---|---|---|
| 1 | A | TM + F + γ | 50 | 30 | 20 | 895 | 1123 | 67 | 0.090 | not present | not present | not present | Inventive example |
| 2 | B | TM + F + γ | 53 | 30 | 17 | 946 | 1092 | 83 | 0.082 | not present | not present | not present | Inventive example |
| 3 | C | TM + F + γ | 58 | 30 | 12 | 904 | 1058 | 53 | 0.075 | not present | not present | not present | Inventive example |
| 4 | D | TM + F + γ | 55 | 32 | 13 | 884 | 1009 | 60 | 0.094 | not present | not present | not present | Inventive example |
| 5 | E | TM + F + γ | 49 | 31 | 20 | 891 | 1065 | 77 | 0.085 | not present | not present | not present | Inventive example |
| 6 | F | TM + F + γ | 53 | 32 | 15 | 869 | 1047 | 57 | 0.098 | not present | not present | not present | Inventive example |
| 7 | G | TM + F + γ | 52 | 31 | 17 | 905 | 1042 | 70 | 0.087 | not present | not present | not present | Inventive example |
| 8 | H | TM + F + γ | 56 | 33 | 11 | 954 | 1039 | 71 | 0.076 | not present | not present | not present | Inventive example |
| 9 | I | TM + F + γ | 49 | 33 | 18 | 895 | 1031 | 64 | 0.089 | not present | not present | not present | Inventive example |
| 10 | J | TM + F + γ | 52 | 33 | 15 | 882 | 1056 | 68 | 0.093 | not present | not present | not present | Inventive example |
| 11 | K | TM + F + γ | 51 | 32 | 17 | 900 | 1067 | 85 | 0.093 | not present | not present | not present | Inventive example |
| 12 | L | TM + F + γ | 51 | 33 | 16 | 912 | 1065 | 68 | 0.104 | not present | not present | not present | Inventive example |
| 13 | M | TM + F + γ | 53 | 33 | 14 | 881 | 999 | 73 | 0.082 | not present | not present | not present | Inventive example |
| 14 | N | TM + F + γ | 47 | 33 | 20 | 909 | 1084 | 55 | 0.110 | not present | not present | not present | Inventive example |
| 15 | O | TM + F + γ | 47 | 39 | 14 | 957 | 1105 | 55 | 0.060 | not present | not present | not present | Inventive example |
| 16 | P | TM + F + γ | 58 | 26 | 16 | 953 | 1057 | 61 | 0.073 | not present | not present | not present | Inventive example |
| 17 | Q | TM + F + γ | 49 | 35 | 16 | 927 | 1047 | 57 | 0.083 | not present | not present | not present | Inventive example |
| 18 | R | TM + F + γ | 56 | 33 | 11 | 988 | 1035 | 58 | 0.085 | not present | not present | not present | Inventive example |
| 19 | S | TM + F + γ | 46 | 37 | 17 | 902 | 1080 | 80 | 0.077 | not present | not present | not present | Inventive example |
| 20 | T | TM + F + γ | 45 | 33 | 22 | 926 | 1135 | 55 | 0.085 | not present | not present | not present | Inventive example |
| 21 | U | TM + F + γ | 48 | 31 | 21 | 907 | 1090 | 62 | 0.085 | not present | not present | not present | Inventive example |
| 22 | V | TM + F + γ | 50 | 32 | 18 | 904 | 1118 | 66 | 0.095 | not present | not present | not present | Inventive example |
| 23 | W | TM + F + γ | 46 | 32 | 22 | 886 | 1128 | 71 | 0.087 | not present | not present | not present | Inventive example |
| 24 | X | TM + F + γ | 54 | 43 | 3 | 946 | 1031 | 22 | 0.076 | not present | present | present | Comparison example |
| 25 | Y | TM + F + γ | 56 | 40 | 4 | 860 | 933 | 23 | 0.107 | not present | present | present | Comparison example |
| 26 | Z | TM + F + γ | 59 | 30 | 11 | 785 | 959 | 131 | 0.104 | not present | not present | not present | Comparison example |
| 27 | AA | TM + F + γ | 61 | 29 | 10 | 713 | 908 | 118 | 0.085 | not present | not present | not present | Comparison example |
| 28 | AB | TM + F + γ | 74 | 17 | 9 | 740 | 915 | 101 | 0.095 | not present | present | present | Comparison example |
| 29 | AC | TM + F + γ | 34 | 42 | 24 | 821 | 1022 | 104 | 0.105 | present | present | present | Comparison example |
| 30 | AD | TM + F + γ | 72 | 21 | 7 | 954 | 1045 | 27 | 0.162 | not present | not present | not present | Comparison example |
| 31 | AE | TM + F + γ | 35 | 38 | 27 | 832 | 1062 | 97 | 0.104 | not present | not present | not present | Comparison example |
| 32 | AF | TM + F + γ | 42 | 52 | 6 | 944 | 1026 | 22 | 0.178 | not present | present | present | Comparison example |
| 33 | M | TM + F + γ | 59 | 32 | 9 | 926 | 1044 | 25 | 0.071 | not present | not present | not present | Comparison example |
| 34 | AG | TM + F + γ | 58 | 31 | 15 | 828 | 1008 | 59 | 0.098 | not present | present | present | Comparison example |
| 35 | AH | TM + F + γ | 52 | 30 | 14 | 834 | 989 | 57 | 0.091 | not present | not present | not present | Comparison example |
| 36 | AI | TM + F + γ | 52 | 31 | 16 | 831 | 990 | 52 | 0.105 | not present | not present | not present | Comparison example |

*TM: tempered martensite, F: ferrite, γ: austenite

All the inventive examples were proved to be high-strength seamless stainless steel pipes for oil country tubular goods which exhibited all of: high strength where a yield strength YS was 862 MPa or more; high toughness where an absorbing energy value at −10° C. is 40 J or more; excellent corrosion resistance (carbon dioxide gas corrosion resistance) in a high temperature corrosive environment at a temperature of 200° C. containing $CO_2$ and $Cl^-$; and excellent sulfide stress cracking resistance and excellent sulfide stress corrosion cracking resistance without generating cracking (SSC, SCC) in an environment containing $H_2S$.

On the other hand, as the seamless stainless steel pipes of the comparison examples which did not fall within the scope of the present disclosure, the steel pipe No. 24 (steel No. X) did not contain W so that the steel pipe No. 24 was determined to be rejection with respect to both sulfide stress cracking resistance (SSC resistance) and sulfide stress corrosion cracking resistance (SCC resistance). Further, a volume ratio of a residual austenite phase of the steel pipe No. 24 was 10% or less and hence, the steel pipe No. 24 was determined to be rejection with respect to toughness.

The steel pipe No. 25 (steel No. Y) contained neither W nor Nb and a value of the left side of the formula (1) was less than 1.0 so that the steel pipe No. 25 was determined to be rejection with respect to strength. Further, the steel pipe No. 25 did not contain W so that the steel pipe No. 25 was determined to be rejection with respect to both sulfide stress cracking resistance (SSC resistance) and sulfide stress corrosion cracking resistance (SCC resistance). Still further, a volume ratio of a residual austenite phase of the steel pipe No. 25 was 10% or less and hence, the steel pipe No. 25 was determined to be rejection with respect to toughness.

In the steel pipe No. 26 (steel No. Z), a value of the left side of the formula (1) was less than 1.0 so that the steel pipe No. 26 could not acquire a desired strength.

In the steel pipe No. 27 (steel No. AA), the content of Nb was less than 0.07 mass % and a value of the left side of the formula (1) is less than 1.0 so that the steel pipe No. 27 could not acquire a desired strength.

In the steel pipe No. 28 (steel No. AB), the content of Nb was less than 0.07 mass % and a value of the left side of the formula (1) was less than 1.0 so that the steel pipe No. 28 could not acquire a desired strength. Further, in the steel pipe No. 28 (steel No. AB), a volume ratio of a ferrite phase was less than 20% so that the steel pipe No. 28 was determined to be rejection with respect to both sulfide stress cracking resistance (SSC resistance) and sulfide stress corrosion cracking resistance (SCC resistance).

In the steel pipe No. 29 (steel No. AC), the content of Cr exceeded 19.0 mass %, a volume ratio of a tempered martensite phase was less than 45% and a volume ratio of a ferrite phase exceeded 40% so that the steel pipe No. 29 could not acquire a desired strength. Further, the content of Mo was 2.0 mass % or less so that the steel pipe No. 29 was determined to be rejection with respect to carbon dioxide gas corrosion resistance, sulfide stress cracking resistance (SSC resistance) and sulfide stress corrosion cracking resistance (SCC resistance).

In the steel pipe No. 30 (steel No. AD), the content of Cr was 15.0 mass % or less, the content of Cu exceeded 3.5 mass % and a volume ratio of a residual austenite phase was 10% or less so that the steel pipe No. 30 was determined to be rejection with respect to toughness and carbon dioxide gas corrosion resistance.

In the steel pipe No. 31 (steel No. AE), the content of Ni was 5.0 mass % or more, a volume ratio of a tempered martensite phase was less than 45%, and a volume ratio of a residual austenite phase exceeds 25% so that the steel pipe No. 31 could not acquire a desired strength.

In the steel pipe No. 32 (steel No. AF), the content of Mo was 2.0 mass % or less, the content of Cu was less than 0.3 mass %, the content of Ni was less than 3.0 mass %, and a volume ratio of a residual austenite phase was 10% or less so that the steel pipe No. 32 was determined to be rejection with respect to toughness, carbon dioxide gas corrosion resistance, sulfide stress cracking resistance (SSC resistance) and sulfide stress corrosion cracking resistance (SCC resistance).

In the steel pipe No. 33 (steel No. M), a volume ratio of a residual austenite phase was 10% or less so that the steel pipe No. 33 was determined to be rejection with respect to toughness.

In the steel pipe No. 34 (steel No. AG), the content of Cu was less than 0.3 mass % so that the steel pipe No. 34 could not acquire a desired strength and was determined to be rejection with respect to sulfide stress cracking resistance (SSC resistance) and sulfide stress corrosion cracking resistance (SCC resistance).

In the steel pipe No. 35 (steel No. AH), the content of Nb was less than 0.07 mass % so that the steel pipe No. 35 could not acquire a desired strength.

In the steel pipe No. 36 (steel No. AI), the left side value of the formula (1) was less than 1.0 so that the steel pipe No. 36 could not acquire a desired strength.

The invention claimed is:

1. A high-strength seamless stainless steel pipe having a composition comprising:

C: 0.05% or less, by mass %;
Si: 1.0% or less, by mass %;
Mn: 0.1 to 0.5%, by mass %;
P: 0.05% or less, by mass %;
S: less than 0.005%, by mass %;
Cr: more than 15.0% to 19.0% or less, by mass %;
Mo: more than 2.0% to 3.0% or less, by mass %;
Cu: 0.3 to 3.5%, by mass %;
Ni: 3.0% or more and less than 5.0%, by mass %;
W: 0.1 to 3.0%, by mass %;
Nb: 0.07 to 0.5%, by mass %;
V: 0.01 to 0.5%, by mass %;
Al: 0.001 to 0.1%, by mass %;
N: 0.010 to 0.100%, by mass %;
O: 0.01% or less, by mass %; and
Fe and unavoidable impurities,
wherein:
Nb, Ta, C, N and Cu satisfy a following formula (1):

$$5.1\times\{(Nb+0.5Ta)-10^{-2.2}/(C+1.2N)\}+Cu\geq 1.0 \quad (1),$$

where, Nb, Ta, C, N and Cu: contents (mass %) of respective elements are expressed as zero when not contained, the steel pipe has a microstructure that is formed of 45% or more of a tempered martensite phase, 20 to 40% of a ferrite phase, and more than 10% and 25% or less of a residual austenite phase in terms of a volume ratio, the steel pipe has a wall thickness of 25.4 mm or more, and the steel pipe has a yield strength YS of 862 MPa or more.

2. The high-strength seamless stainless steel pipe according to claim 1, wherein the composition further comprises one or more selected from the group consisting of:

Ti: 0.3% or less, by mass %;
B: 0.0050% or less, by mass %;
Zr: 0.2% or less, by mass %;
Co: 1.0% or less, by mass %; and
Ta: 0.1% or less, by mass %.

3. The high-strength seamless stainless steel pipe according to claim 1, wherein the composition further comprises one or more selected from the group consisting of:

Ca: 0.0050% or less, by mass %; and

REM: 0.01% or less, by mass %.

4. The high-strength seamless stainless steel pipe according to claim 2, wherein the composition further comprises one or more selected from the group consisting of:

Ca: 0.0050% or less, by mass %; and

REM: 0.01% or less, by mass %.

5. The high-strength seamless stainless steel pipe according to claim 1, wherein the composition further comprises one or more selected from the group consisting of:

Mg: 0.01% or less, by mass %; and

Sn: 0.2% or less, by mass %.

6. The high-strength seamless stainless steel pipe according to claim 2, wherein the composition further comprises one or more selected from the group consisting of:

Mg: 0.01% or less, by mass %; and

Sn: 0.2% or less, by mass %.

7. The high-strength seamless stainless steel pipe according to claim 3, wherein the composition further comprises one or more selected from the group consisting of:

Mg: 0.01% or less, by mass %; and

Sn: 0.2% or less, by mass %.

8. The high-strength seamless stainless steel pipe according to claim 4, wherein the composition further comprises one or more selected from the group consisting of:

Mg: 0.01% or less, by mass %; and

Sn: 0.2% or less, by mass %.

9. A method of manufacturing the high-strength seamless stainless steel pipe according to claim 1, the method comprising the steps of:

heating a steel pipe material at a temperature that falls within a range from 1100 to 1350° C. and applying hot working to the steel pipe material to form a seamless steel pipe having a predetermined shape;

applying a quenching treatment to the seamless steel pipe after the hot working, the quenching treatment including:

reheating the seamless steel pipe to a temperature that falls within a range of from 850 to 1150° C., and cooling the seamless steel pipe at a cooling rate of air cooling or more until a surface temperature of the seamless steel pipe becomes a cooling stop temperature that is 50° C. or below and above 0° C.; and applying a tempering treatment to the seamless steel pipe such that the seamless steel pipe is heated at a tempering temperature that falls within a range of from 500 to 650° C.

10. A method of manufacturing the high-strength seamless stainless steel pipe according to claim 2, the method comprising the steps of:

heating a steel pipe material at a temperature that falls within a range from 1100 to 1350° C. and applying hot working to the steel pipe material to form a seamless steel pipe having a predetermined shape;

applying a quenching treatment to the seamless steel pipe after the hot working, the quenching treatment including:

reheating the seamless steel pipe to a temperature that falls within a range of from 850 to 1150° C., and cooling the seamless steel pipe at a cooling rate of air cooling or more until a surface temperature of the seamless steel pipe becomes a cooling stop temperature that is 50° C. or below and above 0° C.; and applying a tempering treatment to the seamless steel pipe such that the seamless steel pipe is heated at a tempering temperature that falls within a range of from 500 to 650° C.

11. A method of manufacturing the high-strength seamless stainless steel pipe according to claim 3, the method comprising the steps of:

heating a steel pipe material at a temperature that falls within a range from 1100 to 1350° C. and applying hot working to the steel pipe material to form a seamless steel pipe having a predetermined shape;

applying a quenching treatment to the seamless steel pipe after the hot working, the quenching treatment including:

reheating the seamless steel pipe to a temperature that falls within a range of from 850 to 1150° C., and cooling the seamless steel pipe at a cooling rate of air cooling or more until a surface temperature of the seamless steel pipe becomes a cooling stop temperature that is 50° C. or below and above 0° C.; and applying a tempering treatment to the seamless steel pipe such that the seamless steel pipe is heated at a tempering temperature that falls within a range of from 500 to 650° C.

12. A method of manufacturing the high-strength seamless stainless steel pipe according to claim 4, the method comprising the steps of:

heating a steel pipe material at a temperature that falls within a range from 1100 to 1350° C. and applying hot working to the steel pipe material to form a seamless steel pipe having a predetermined shape;

applying a quenching treatment to the seamless steel pipe after the hot working, the quenching treatment including:

reheating the seamless steel pipe to a temperature that falls within a range of from 850 to 1150° C., and cooling the seamless steel pipe at a cooling rate of air cooling or more until a surface temperature of the seamless steel pipe becomes a cooling stop temperature that is 50° C. or below and above 0° C.; and applying a tempering treatment to the seamless steel pipe such that the seamless steel pipe is heated at a tempering temperature that falls within a range of from 500 to 650° C.

13. A method of manufacturing the high-strength seamless stainless steel pipe according to claim 5, the method comprising the steps of:

heating a steel pipe material at a temperature that falls within a range from 1100 to 1350° C. and applying hot working to the steel pipe material to form a seamless steel pipe having a predetermined shape;

applying a quenching treatment to the seamless steel pipe after the hot working, the quenching treatment including:

reheating the seamless steel pipe to a temperature that falls within a range of from 850 to 1150° C., and cooling the seamless steel pipe at a cooling rate of air cooling or more until a surface temperature of the seamless steel pipe becomes a cooling stop temperature that is 50° C. or below and above 0° C.; and applying a tempering treatment to the seamless steel pipe such that the seamless steel pipe is heated at a tempering temperature that falls within a range of from 500 to 650° C.

14. A method of manufacturing the high-strength seamless stainless steel pipe according to claim 6, the method comprising the steps of:

heating a steel pipe material at a temperature that falls within a range from 1100 to 1350° C. and applying hot working to the steel pipe material to form a seamless steel pipe having a predetermined shape;

applying a quenching treatment to the seamless steel pipe after the hot working, the quenching treatment including:

reheating the seamless steel pipe to a temperature that falls within a range of from 850 to 1150° C., and cooling the seamless steel pipe at a cooling rate of air cooling or more until a surface temperature of the seamless steel pipe becomes a cooling stop temperature that is 50° C. or below and above 0° C.; and applying a tempering treatment to the seamless steel pipe such that the seamless steel pipe is heated at a tempering temperature that falls within a range of from 500 to 650° C.

15. A method of manufacturing the high-strength seamless stainless steel pipe according to claim 7, the method comprising the steps of:

heating a steel pipe material at a temperature that falls within a range from 1100 to 1350° C. and applying hot working to the steel pipe material to form a seamless steel pipe having a predetermined shape;

applying a quenching treatment to the seamless steel pipe after the hot working, the quenching treatment including:

reheating the seamless steel pipe to a temperature that falls within a range of from 850 to 1150° C., and cooling the seamless steel pipe at a cooling rate of air cooling or more until a surface temperature of the seamless steel pipe becomes a cooling stop temperature that is 50° C. or below and above 0° C.; and applying a tempering treatment to the seamless steel pipe such that the seamless steel pipe is heated at a tempering temperature that falls within a range of from 500 to 650° C.

16. A method of manufacturing the high-strength seamless stainless steel pipe according to claim 8, the method comprising the steps of:

heating a steel pipe material at a temperature that falls within a range from 1100 to 1350° C. and applying hot working to the steel pipe material to form a seamless steel pipe having a predetermined shape;

applying a quenching treatment to the seamless steel pipe after the hot working, the quenching treatment including:

reheating the seamless steel pipe to a temperature that falls within a range of from 850 to 1150° C., and cooling the seamless steel pipe at a cooling rate of air cooling or more until a surface temperature of the seamless steel pipe becomes a cooling stop temperature that is 50° C. or below and above 0° C.; and applying a tempering treatment to the seamless steel pipe such that the seamless steel pipe is heated at a tempering temperature that falls within a range of from 500 to 650° C.

17. The high-strength seamless stainless steel pipe according to claim 1, wherein the steel pipe has a wall thickness of 25.4 mm or more and 34 mm or less.

* * * * *